US005582142A

United States Patent [19]

Neubrander

[11] Patent Number: 5,582,142

[45] Date of Patent: Dec. 10, 1996

[54] ROCKER ARM

[75] Inventor: Jürgen Neubrander, Stuttgart, Germany

[73] Assignee: Dr. Ing. h.c.F. Porsche AG, Germany

[21] Appl. No.: 429,855

[22] Filed: Apr. 27, 1995

[30] Foreign Application Priority Data

May 4, 1994 [DE] Germany ..... 44 15 608.1

[51] Int. Cl.[6] ..... F01L 1/18

[52] U.S. Cl. ..... 123/90.39; 123/90.51; 123/90.44; 74/519; 74/559

[58] Field of Search ..... 123/90.39, 90.44, 123/90.45, 90.46, 90.48, 90.51; 74/519, 559; 29/888.2

[56] References Cited

U.S. PATENT DOCUMENTS

| | | | |
|---|---|---|---|
| 4,153,017 | 5/1979 | Behnke | 123/90.48 |
| 4,624,224 | 11/1986 | Kodama et al. | 123/90.46 |
| 4,628,874 | 12/1986 | Barlow | 123/90.39 |
| 4,870,931 | 10/1989 | Nakamura et al. | 123/90.51 |
| 5,163,391 | 11/1992 | Green et al. | 123/90.39 |
| 5,195,473 | 3/1993 | Kano et al. | 123/90.39 |
| 5,251,585 | 10/1993 | Graber | 123/90.39 |

FOREIGN PATENT DOCUMENTS

3526292A1 3/1986 Germany .

OTHER PUBLICATIONS

Patent Abstract of Japan; JP 54–130427 dated Sep. 10, 1979 to Sugimoto Shigetoshi et al.

"Werkstoffkunde kurz und einprägsam", Dr–Ing. Erich Baumgartl, VEB Fachbuchverlag Leipzig 1976, pp. 5, 68–71 and 144–147.

*Primary Examiner*—Weilun Lo

*Attorney, Agent, or Firm*—Evenson, McKeown, Edwards & Lenahan P.L.L.C.

[57] ABSTRACT

A rocker arm for a valve train of an internal combustion engine has a cam travel surface for a cam support, a recess for a hydraulic valve-play adjusting element and a rocker arm shaft located therebetween. The rocker arm consists of higher-strength chilled cast iron in a first area around the cam travel area, that has a greater hardness than the second and third areas around the rocker arm shaft, which are composed of nodular cast iron, and around the cylindrical recess that is cast into the rocker arm.

8 Claims, 4 Drawing Sheets

ROCKER ARM

BACKGROUND AND SUMMARY OF THE INVENTION

The invention relates to a rocker am for a valve train of an internal combustion engine having a cam contacting surface for a cam support, a recess for a hydraulic valve-play adjusting element, and a rocker arm shaft located therebetween.

Rocker arms of conventional design are manufactured by the Croning method, and subjected to special heat treatment to produce a hard cam contacting surface. A recess in the form of above for receiving a hydraulic valve-play adjusting element is then provided in the rocker arm.

One object of the present invention is to provide a rocker arm that can be manufactured simply using the Croning method casting, but without costly machining.

This goal is achieved by the rocker arm according to the invention which is made by the Croning casting method and consists of higher-strength cast iron. It has a much greater hardness in the vicinity of its cam contacting surface than in the vicinity of the recess for the hydraulic valve-play adjusting element, or near the rocker armshaft bearing and the oil supply bore. The higher-strength cast iron, after pouring, consists of a chilled cast iron in the vicinity of the cam contacting surface, and a nodular cast iron in the vicinity of the rocker arm shaft bearing up to the recess for the valve-play adjusting element. In the vicinity of the cam contacting surface, the structure of the rocker arm consists of ledeburite and a small quantity of nodular graphite, and is relatively hard. This arrangement eliminates the need for additional machining or the addition of a hardened plate.

The area around the rocker arm shaft bearing up to the recess consists of a structure composed of perlite, ferrite, and nodular graphite, so that the material is softer than the cam contacting surface. This soft area of the rocker arm is necessary in order to permit accurate drilling of the recess without a great deal of expenditure of labor, and drilling of a lubricating bore from the rocker arm axis to the recess in simple fashion.

The recess has a relatively thin wall and is produced during casting by a core insert, so that subsequent machining is inexpensive, and considerably simplified. The area around the recess for the rocker arm has a perlite-ferrite-nodular graphite structure, so that despite the relatively thin walls, the recess has a wall thickness that can correspond roughly to one-third of the radius of the receiving bore in the rocker arm, which is favorable from the standpoint of weight.

The different degrees of hardness of the rocker arm and the cam contacting surface, starting from one free end and extending up to the recess at the other free end of the rocker arm are produced by casting. The harder area of the rocker arm in the cam contacting area, produced in chilled cast iron, is produced by means of a densener which disposed adjacent this surface during the casting process, so that this area of the rocker arm solidifies more rapidly than the remaining part around the shaft and the recess for the rocker arm.

Other objects, advantages and novel features of the present invention will become apparent from the following detailed description of the invention when considered in conjunction with the accompanying drawings.

DETAILED DESCRIPTION OF TEE DRAWINGS

Figure 1:
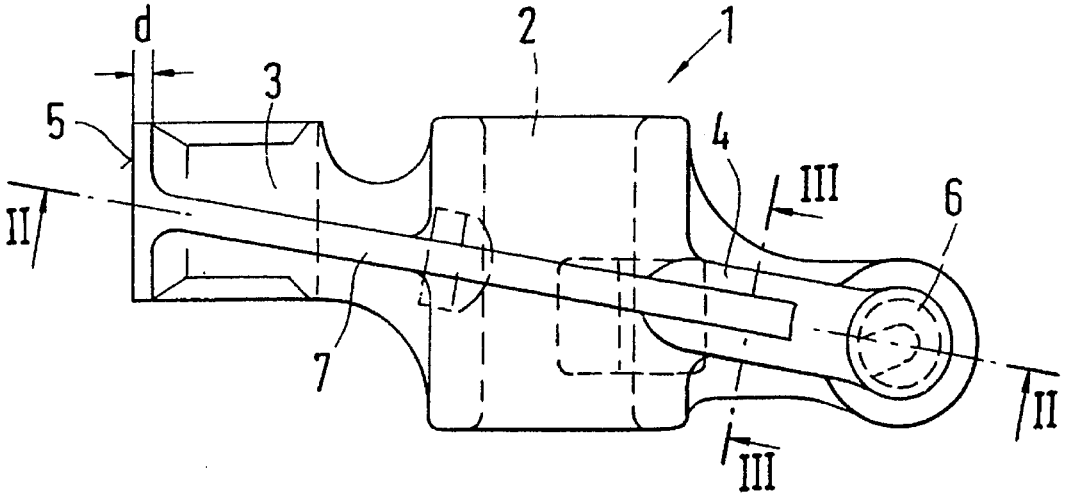
FIG. 1 is a top view of a rocker arm.
Figure 3:
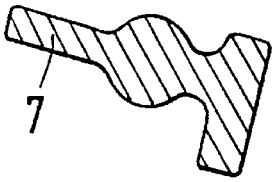
FIG. 3 is a section along line III—III in FIG. 1.
Figure 2:
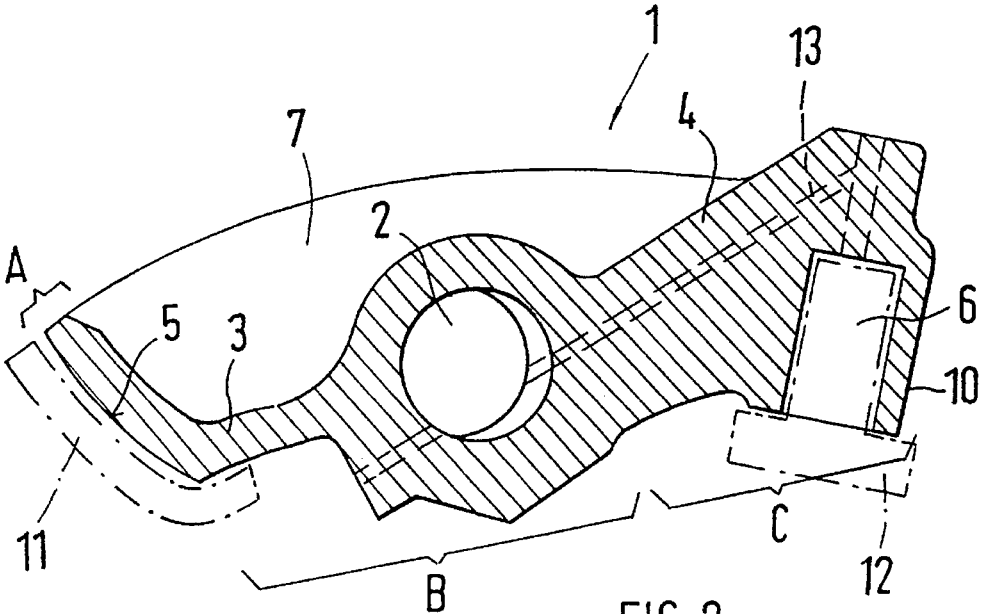
FIG. 2 shows a rocker arm in section along line II—II in FIG. 1.

Referring to FIGS. 1–3, rocker arm 1 consists essentially of a higher-strength cast iron, such as GGG 60 and GGG 70 for example, and is preferably cast using the Croning method. This cast iron is composed of the alloy elements listed below, with slight variations upward and downward. The higher-strength cast iron used has a chemical composition (in %) with alloy elements C 3.5 to 4.0, Si 1.7 to 2.8, Mn≦0.6, P≦0.1, S≦0.01, Mg 0.03 to 0.06, Ni≦1.5, Cu≦1.5, chromium≦0.3, Mo≦0.5.

Rocker arm 1 comprises a lever portion 3 and 4 extending to either side from a bore 2 which bears the rocker arm 1 on a rocker arm shaft (not shown), with lever 3 having a convex cam contacting surface 5 and lever 4 having a recess 6 for a hydraulic valve-play adjusting element, not shown in greater detail. A rib 7 runs from cam travel surface 5 to recess 6 on the top of rocker arm 1.

Rocker arm 1 is composed of chilled cast iron in area A of the cam contacting surface, and of nodular cast iron in area B of rocker arm shaft bore 2 and in area C of recess 6.

Figure 4:
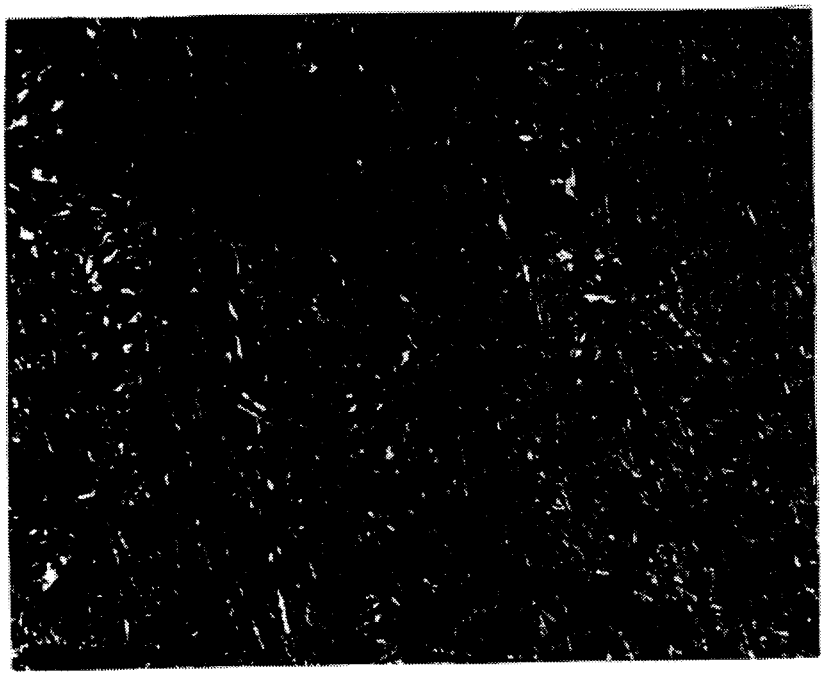
FIG. 4 is a structural diagram of the cam travel surface area.
Figure 5:
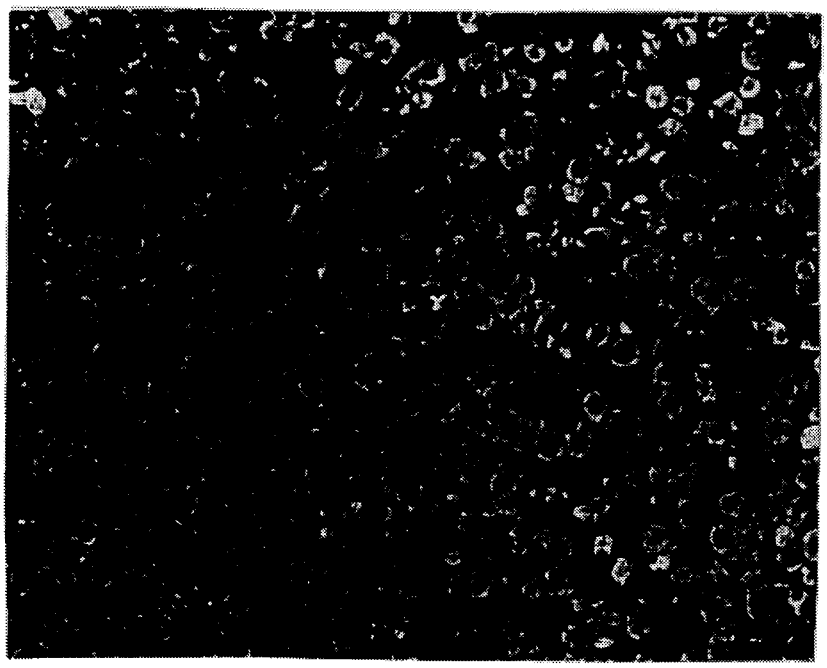
FIG. 5 is a structural diagram of the area between the recess and the rocker arm shaft.
Figure 6:
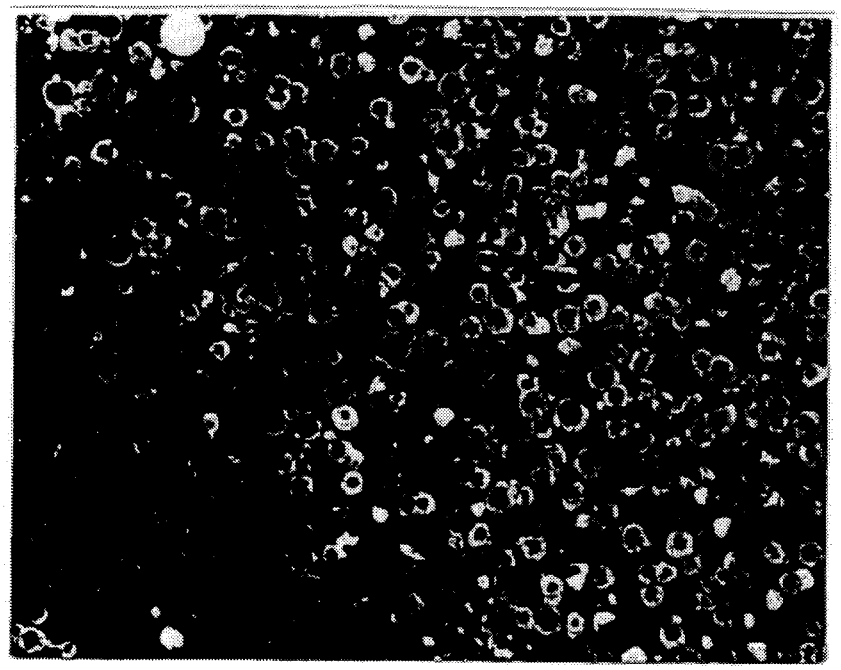
FIG. 6 is a structural diagram of the area of the recess.

By providing a densener 11 in front of cam contacting surface 5, optimum hardening of this area and hence chilled cast iron with a special structure is produced, as shown in greater detail in FIG. 4. As a result, area A of cam travel surface 5 is harder than the areas B and C around rocker arm shaft bore 2 and recess 6 respectively, which have the structure shown in FIGS. 5 and 6. As shown in FIGS. 1 and 2, the thickness of the wall area adjacent the cam surface 5 is approximately the same as that of the rib 7.

The white-solidified structure (FIG. 4) of rocker arm 1 in area A of cam contacting surface 5 consists of ledeburite and a small amount of nodular graphite. The adjoining areas B (FIG. 5) around rocker arm shaft bore 2 and area C (FIG. 6) around recess 6 have a gray-solidified structure made of perlite, ferrite, and nodular graphite, and area C can contain a small amount of lamellar graphite. The structure in areas B and C can contain traces of ledeburite. Between area A of rocker arm 1 and area B is a transition zone with perlite, ferrite, nodular graphite, and an increased content of ledeburite.

Recess 6 in lever 4 of rocker arm 1 is made during the casting process, by means of a core insert 12. As a result, and because of the higher-strength cast material, a relatively thin wall 10 can be produced in recess 6 which, because of hardening after casting with formation of a perlite-ferrite-nodular graphite structure, is softer than area A of cam contacting surface 5.

The softer areas B and C permit any machining of rocker arm 1 that may be necessary after casting. Recess 6 is drilled to size, oil channel 13 is drilled, and the rocker arm shaft bearing is sized.

Recess 6 is shaped by means of core insert 12 that has been inserted in such manner that a defined wall of limited thickness is produced. This is advantageous for subsequent machining as far as drilling effort is concerned. In addition, no hard cast material is produced in the limited wall thickness because of the alloy composition of the higher-strength cast iron.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. Rocker arm for a valve train of an internal combustion engine having a cam contacting surface, a recess for a hydraulic valve-play adjusting element and a rocker arm shaft bearing located therebetween, wherein:

said rocker arm comprises nodular cast iron in the areas of said recess and said rocker arm shaft bearing; and said rocker arm comprises chilled cast iron in the area of the cam contacting surface, which material has a higher strength and greater hardness than that in the areas of said recess and said rocker arm shaft bearing;

wherein a structure of the rocker arm in the area of the cam contacting surface consists of ledeburite and a small amount of nodular graphite, and in the areas of the recess and the rocker arm shaft bearing consists of perlite, ferrite and nodular graphite.

2. Rocker arm according to claim 1 wherein the structure of rocker arm shaft bearing and recess have traces of ledeburite, with a transition zone between the area of the cam contacting surface and that of the rocker arm shaft bearing containing a greater amount of ledeburite than in the rocker arm shaft bearing and recess areas.

3. Rocker arm according to claim 1 wherein a cast recess forms a bore for receiving a valve-play adjusting element, and a lubricating oil bore is provided in the rocker arm from the bore to rocker arm shaft bearing, said lubricating oil bore being able to be provided in the softer structure of rocker arm which consists of nodular cast iron.

4. Rocker arm according to claim 2 wherein a cast recess forms a bore for receiving a valve-play adjusting element, and a lubricating oil bore is provided in the rocker arm from the bore to rocker arm shaft bearing, said lubricating oil bore being able to be provided in the softer structure of rocker arm which consists of nodular cast iron.

5. Rocker arm according to claim 1 wherein a core insert for forming said recess has a diameter such that a thin wall is formed with a perlite, ferrite, and nodular graphite structure.

6. Rocker arm according to claim 3 wherein a core insert for forming said recess has a diameter such that a thin wall is formed with a perlite, ferrite, and nodular graphite structure.

7. Rocker arm according to claim 1 wherein thickness of a wall of the recess corresponds to approximately one-third of a radius of a cylindrical recess of the rocker arm.

8. Rocker arm for a valve train of an internal combustion engine having a first area comprising a cam contacting surface, a second area comprising a recess for a hydraulic valve-play adjusting element and a third area comprising a rocker arm shaft bearing, wherein:

said first, second and third areas have differing degrees of hardness which merge with one another in intermediate areas therebetween;

said first area has a hardness which is greater than said second and third areas, being produced by means of a densener located directly adjacent the cam contacting surface during casting of said rocker arm; and said first area has a thickness approximately equal to that of a rib spanning the rocker arm;

wherein a structure of the rocker arm in the area of the cam contacting surface consists of ledeburite and a small amount of nodular graphite, and in the areas of the recess and the rocker arm shaft bearing consists of perlite, ferrite and nodular graphite.

* * * * *